US006425814B1

(12) United States Patent
Graf

(10) Patent No.: US 6,425,814 B1
(45) Date of Patent: Jul. 30, 2002

(54) DEVICE FOR PROCESSING A CARD CLOTHING

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 09/614,641

(22) Filed: Jul. 12, 2000

(30) Foreign Application Priority Data

Jul. 13, 1999 (DE) ..... 199 32 690

(51) Int. Cl.[7] ..... B24B 19/18
(52) U.S. Cl. ..... 451/416; 451/426
(58) Field of Search ..... 451/416, 426, 451/427, 423, 417

(56) References Cited

U.S. PATENT DOCUMENTS 5,797,788 A * 8/1998 Graf et al. ..... 451/28
6,106,381 A * 8/2000 Leder et al. ..... 451/416

FOREIGN PATENT DOCUMENTS

DE 196 05 635 C2 5/1998

* cited by examiner

*Primary Examiner*—Robert A. Rose
(74) *Attorney, Agent, or Firm*—Friedrich Kueffner

(57) ABSTRACT

A device for processing a card clothing mounted on a card clothing carrier, particularly an all-steel sawtooth card clothing carrier, has at least one processing tool and a guiding device for guiding the processing tool along a predetermined path. The guiding device has at least two guiding elements which can be adjusted between a work position and a transport position. The guiding elements extend in the work position along a longer portion of the predetermined path than in the transport position.

18 Claims, 2 Drawing Sheets

DEVICE FOR PROCESSING A CARD CLOTHING

BACKGROUND OF THE INVENTION

1. Field of the Invention

The present invention relates to a device for processing a card clothing mounted on a card clothing carrier, particularly an all-steel sawtooth card carrier, with at least one processing tool and a guiding device serving for guiding the processing tool along a predetermined path.

2. Description of the Related Art

Devices of this type are used, for example, for maintaining and starting the operation of cards and carding machines. A card is used in fiber processing for cleaning and parallelizing individual fibers. For this purpose, a card is equipped with a drum and a plurality of so-called flats. The drum referred to is an approximately circular cylindrical cylinder which is equipped on its outer surface with a clothing generally formed of a sawtooth wire extending in a coil shape, wherein the circular cylindrical cylinder serving as the carrier is rotatable about its cylinder axis. Referred to as the flats are fiber processing elements which extend approximately parallel to the cylinder axis of the drum, wherein the fiber processing elements are equipped on its side facing the drum clothing with a clothing composed, for example, of sawtooth wire sections or card wires. For fiber processing, the drum is rotated and the drum takes along the fibers to be processed, wherein the fibers are parallelized and cleaned as a result of the cooperation of the drum clothing and the flat clothings. Fiber processing tools which are similar to the drum of a card and which also are usually called drums are used in carding machines which are used for manufacturing or processing worsted yarns, synthetic fibers, non-woven fabrics, cotton wool, etc.

During this fiber processing, a significant wear and also a significant contamination of the drum clothing occurs. For this reason, it is necessary to regularly regrind and/or clean the drum clothing. Usually used for regrinding the drum clothing are grinding devices which can be secured to the card frame and extend essentially in the direction of the cylinder axis of the drum, wherein the grinding devices can grind the clothing mounted on the circular cylindrical or roll-shaped carrier of the drum during a rotation of the drum. In view of the fact that the drum of a card has in the longitudinal direction of the cylinder axis usually a width of at least 1.5 meters and the drum of a carding machine may have a length of up to 5 meters, grinding elements are usually used which can be moved back and forth along a guiding device extending parallel to the cylinder axis of the drum, so that the entire width of the drum can be processed using a relatively small grinding element.

Devices of the type described last are disclosed, for example, in DE-A-196 05 635. With respect to a construction, the operation and the assembly of a grinding device suitable for regrinding a drum clothing, the disclosure content of this document is hereby incorporated into this description by express reference.

Even though it is possible to carry out a reliable and effective processing of all-steel sawtooth card clotting, using the grinding devices known from the cited document, it has been found that the assembly of the known processing devices regularly poses significant problems with respect to the generally very narrow space available in the area of a card and particularly in the area of a carding machine.

In view of these problems in the prior art, the invention is based on the object of providing a device for processing a clothing mounted on a clothing carrier which can be easily mounted at the location of use while ensuring a satisfactory operation.

According to the invention, this object is met by a further development of the known processing devices which is essentially characterized in that the guiding device has at least two guiding elements which are adjustable between a work position and a transport position, wherein the guiding elements extend in the work position along a longer portion of the predetermined path than in the transport position.

This solution of the object of the invention is based on the finding that the principal difficulty in the assembly of the known processing devices is in the transport of this processing device to the location of use, because the guiding devices of the processing device must have a length which corresponds approximately to the length of the predetermined path. This length of the guiding device constructed, for example, in the form of a guiding rail, may be up to 4.5 m in a processing device which can be used for regrinding the drum of a carding machine, so that a transport of these processing devices is hardly possible particularly in view of the narrow space available in factory buildings.

In the further development of the known processing device according to the present invention, this problem is solved by dividing the guiding device which predominantly determines the dimensions of the processing device into at least two guiding elements, so that the total length of the processing device is reduced for transporting purposes to at least about half. Consequently, a simple transport of the processing device according to the invention to the location of use is made possible. At the location of use itself, the processing device according to the invention can then be adjusted in a simple manner into the work position in which the guiding elements extend along the total predetermined path, i.e., for example, along the total width of the drum of a carding machine in the direction of the drum axis over 2.5 to 5 meters, so that a complete processing of the clothing is made possible.

Even though the processing device according to the invention may also have two guiding elements which are completely separated from each other in the transport position it has been found particularly advantageous for the transport and the assembly if the guiding elements are still connected to each other even in the transport position because this ensures that the individual guiding elements are always assigned to the corresponding guiding elements. In this connection, it has been found particularly advantageous structurally as well as for ensuring a high operational reliability if the guiding elements are connected to each other through a joint preferably in the form of a flap-type hinge having a hinge axis extending perpendicularly of the predetermined path because the individual joint elements, such as the individual hinge flaps, can be attached particularly simply to the guiding elements and the use of a hinge having an axis extending perpendicularly of the predetermined path already ensures an alignment in a plane of the individual guiding elements formed, for example, by guiding rails. The assembly can be further simplified if the individual guiding elements each have an end face extending approximately perpendicularly of the predetermined path, wherein these end faces rest against each other in the work position and are arranged next to each other in the same plane in the transport position.

For ensuring a particularly high operational safety in the work position, the processing device according to the invention is advantageously equipped with at least one stabilizing element for stabilizing the guiding elements in the work position wherein the stabilizing element can be secured to at least one of the guiding elements. Such a stabilizing element may be constructed, for example, in the form of a stabilizing rail extending over the joint which connects the two guiding elements with each other. A particularly good stabilization is achieved if the stabilizing element has an approximately T-shaped cross-section in a sectional plane extending perpendicularly of the predetermined path because this ensures a particularly high geometrical moment of inertia of the stabilizing element.

As already mentioned above, it is particularly advantageous if the stabilizing element extends in the work position over the joint connecting the guiding elements because this ensures a protection of the joint, on the one hand, and an unintentional pivoting movement of the guiding elements about the joint axis can be reliably prevented, on the other hand. For this purpose, in accordance with a particularly advantageous further development of the invention, the stabilizing element is provided with at least one spacer member by means of which the stabilizing element can be secured to at least one of the guiding elements while forming an intermediate space serving for receiving at least one of the components of the joint or hinge.

A particularly secure locking of the guiding elements in the work position can be achieved if the stabilizing element and/or the hinge has at least one coupling area preferably extending along the predetermined path for effecting a positively connecting engaging connection with a coupling area of the guiding element of complimentary construction, because this makes it possible to reliably prevent a tilting motion of the two guiding elements about a tilting axis extending transversely of the hinge axis. The coupling areas can be realized structurally in a particularly simple manner if they are constructed in the form of grooves formed in the guiding elements and being in alignment with each other in the work position wherein corresponding coupling ledges of the stabilizing element and/or the joint engage in the grooves.

The above-described locking of the guiding elements in the work position can be ensured without influencing the operability of the processing tool if the joint and/or the stabilizing element is arranged on a side of the guiding device located opposite the work position of the clothing to be processed, wherein the guiding device is realized, for example, in the form of a guiding rail having an approximately square cross-section.

Event though the device according to the invention can also advantageously be used in those processing devices in which the processing tool is moved automatically along the predetermined path by the rotating motion of the clothing mounted in the shape of a coil on a circular cylindrical carrier, as, for example, when using a cleaning tool with cleaning blades extending into the clothing lanes formed between the individual coils of the clothing, it has been found particularly advantageous especially in devices for regrinding a clothing if the processing tool is coupled through a traction member preferably in the form of a toothed belt extending around a drive roller and a guide roller to a drive device serving for moving the processing tool along the redetermined path. In this connection, for avoiding an excessive elongation of the traction member when adjusting the processing device according to the invention between the work position and the transport position, it has been found particularly advantageous, if the traction member is releasably fastened to the processing tool.

For simplifying the assembly of such a processing device, it has been found advantageous if the traction member is fastened for this purpose to a fastening element of the processing tool which is releasably connected to a processing element of the processing tool. In the case of an adjustment from the work position into the transport position it is then possible to separate the fastening element together with the traction member from the processing element and it can simultaneously also be ensured that the fastening element with the traction member fastened thereto and separated from the processing element is guided along a guide means formed in the guiding elements, so that an uncontrolled movement of the traction member separated from the processing tool is prevented.

For this purpose, the processing device according to the invention may additionally include a limiting element which can be secured relative to the guiding device and is movable preferably along the predetermined path for limiting the movement of the fastening element of the processing tool separated from the processing element along the predetermined path. The just-described guidance of the fastening element separated from the processing element can be realized in a particularly simple manner if at least one of the guiding elements has a guiding groove extending along the predetermined path for receiving a guiding portion of the processing tool because this guiding groove can also be utilized for guiding the fastening element. IN the embodiment of the invention described last, the fastening element may have a stop area for preventing the fastening element from completely penetrating into the guiding groove after the fastening element has been separated from the processing element. Such a fastening element may have, for example, an approximately T-shaped cross-section in a plane extending perpendicularly of the predetermined path with a leg received in the guiding groove and a leg resting on both sides of the guiding groove against a guiding surface of the guiding element.

A particularly compact construction of the device according to the invention can be achieved if the guiding groove opens into a hollow space extending in the guiding element in the direction of the predetermined path and serving for receiving the traction member. Such a guiding element can be realized, for example, in the form of a hollow aluminum section.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
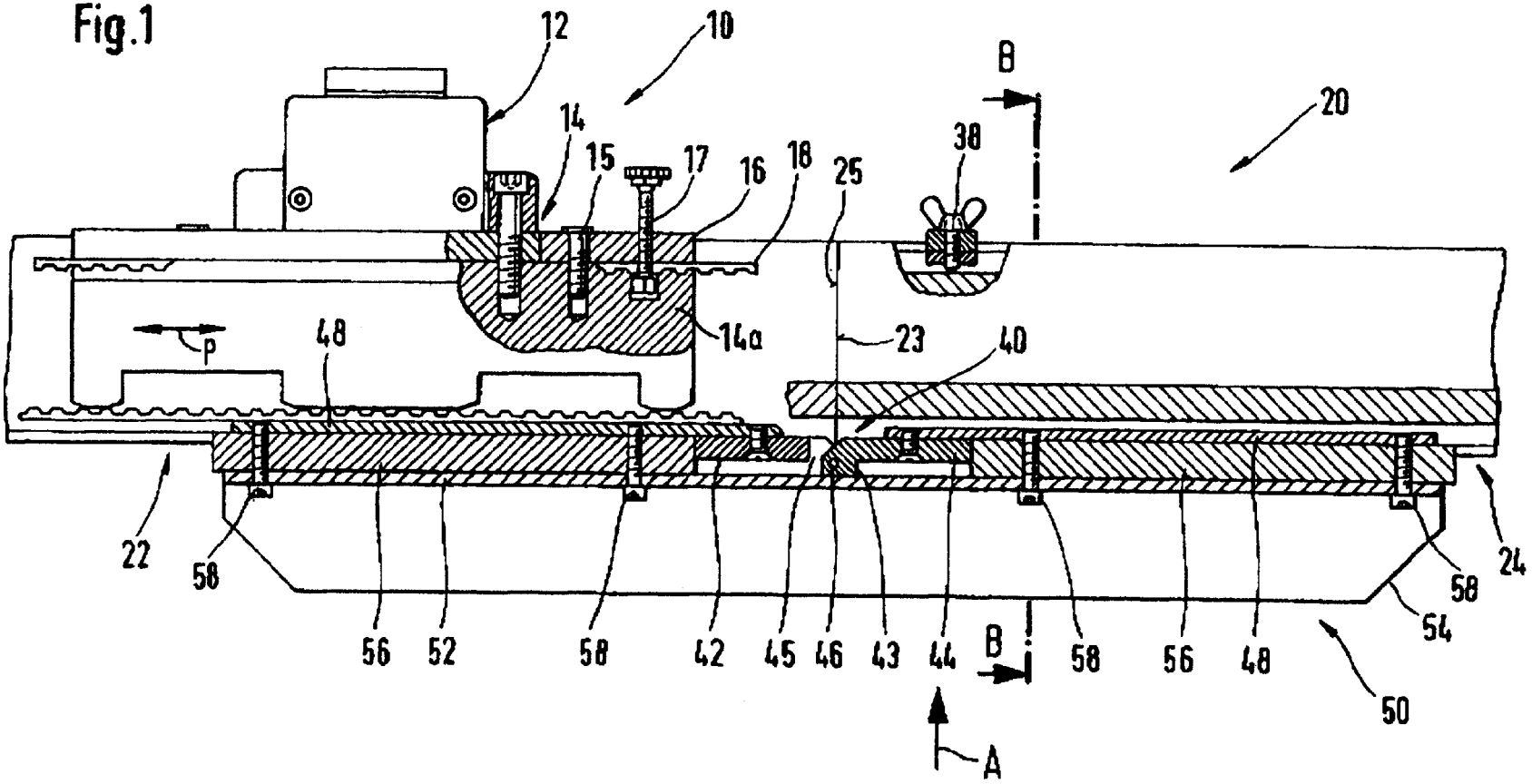
FIG. 1 is a partially sectional side view of a processing device according to the invention.

The processing device illustrated in the drawing is composed essentially of a processing tool in its totality indicated by 10 and a grinding head 12 and a carriage 14 and of a guiding device in its totality denoted by 20.

The guiding device 20 is composed of two guiding rails 22 and 24 which are connected to each other through a joint 40 formed in the form of a flap-type hinge.

Figure 2:
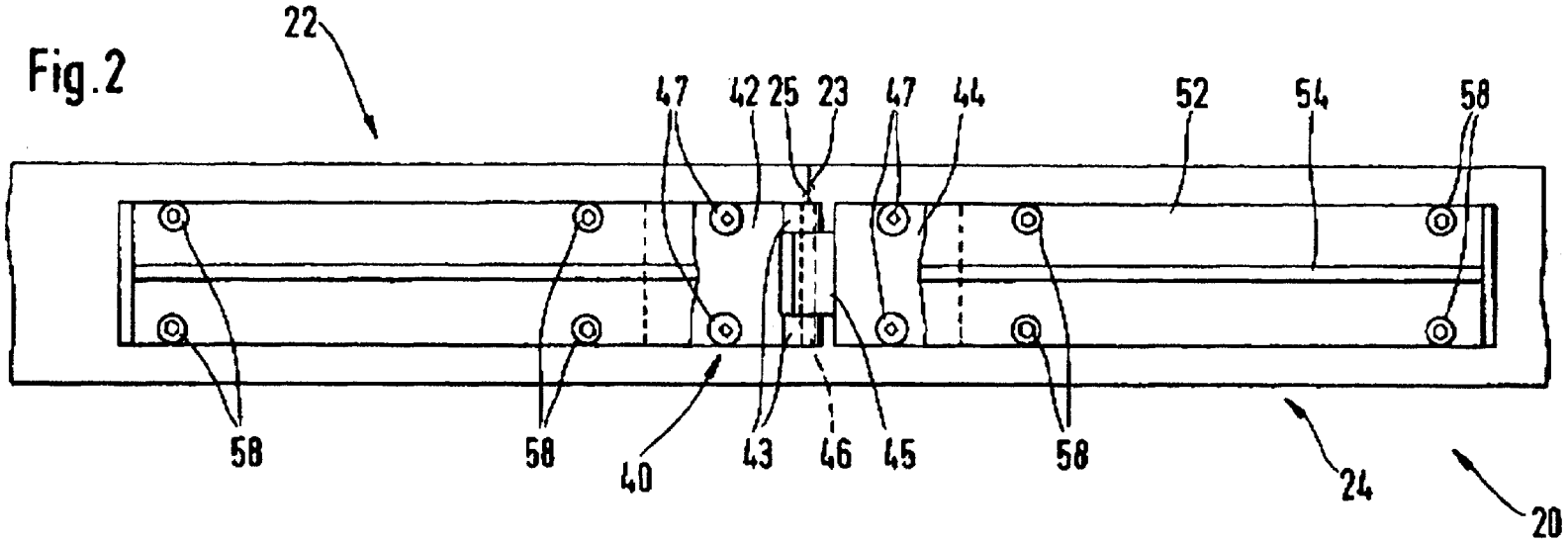
FIG. 2 is a view of the processing device shown in FIG. 1 in the direction indicated by arrow A in FIG. 1.
Figure 3:
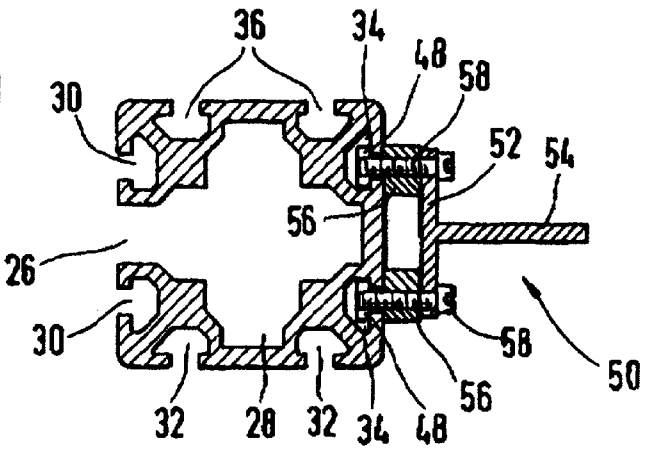
FIG. 3 is a sectional view of the processing device shown in FIG. 1 along the sectional plane B—B indicated in FIG. 1

As illustrated particularly clearly in FIG. 3, each of the guide rails 22 and 24 is constructed in the from of a hollow aluminum section. IN the work position of the processing device according to the invention illustrated in FIGS. 1 and 2, the processing tool 10 can be moved back and forth in the directions indicated by double arrow P. For this purpose, the carriage 14 is coupled to a traction member in the form of a toothed belt 18 which extends around a drive roller and a guide roller. The toothed belt is received in a hollow space 28 extending through the guide rails 22 and 24 in the longitudinal direction thereof. For guiding the movement of the carriage in the directions indicated by arrow P, the carriage is equipped with a guiding area which is received in a groove 26 (see FIG. 3) of the guide rails 22 and 24 which leads into the hollow space 28. With respect to the construction of the grinding head 12, reference is made to the description in DE-A-196 05 653.

In the work position of the processing device according to the invention shown in FIGS. 1 and 2, the guide rails 22 and 24 rest against each other with end faces 23 and 25 extending perpendicularly of the directions of movement of the processing tool indicated by double arrow P, so that the guiding grooves 26 formed in the guiding rails 22 and 24 and the hollow spaces 28 are in alignment with each other. As shown particularly clearly in FIG. 3, the guiding rails 22 and 24 have an essentially square cross-section, wherein, in addition to the guiding groove 26, provided in each of the side surfaces of the guiding rails 22 and 24 are always two grooves 30, 32, 34 and 36 with an essentially T-shaped cross-section and extending in the longitudinal direction of the guiding rails, wherein additional elements of the processing device according to the invention are secured in the grooves, such as, a limiting element 38 (see below) or a stabilizing element 50 (see below).

The flap-type hinge which connects the two guiding rails to each other is arranged on the side of the guiding rails 22 and 24 facing away from the grinding head 12 and the guiding groove 26. The hinge 40 includes a first hinge flap 42 secured to the guiding rail 22 and a second hinge flap 44 secured to the guiding rail 24. At their ends facing each other, the hinge flaps 42 and 44 are equipped with receiving areas 43 and 45 for receiving a hinge pin 46. The receiving area 45 provided at the hinge flap 44 is arranged between the receiving areas 43 arranged at the hinge flap 42. The hinge pin 46 and, thus, also the hinge axis extend in a direction extending perpendicularly of the longitudinal direction of the guiding rails 22 and 24, so that the guiding rails 22 and 24 can be folded together from the work position shown in FIGS. 1 and 2 by a pivoting movement, such that the end faces 23 and 25 which rest against each other in FIGS. 1 and 2 are located in a plane in the folded-up state and the total arrangement composed of the guiding rails 22 and 24 now only has approximately half the length as compared to the work position illustrated in FIGS. 1 and 2.

As is particularly clear from looking at FIGS. 1 and 3 together, the hinge flaps 42 and 44 are mounted by screws 47 at fastening ledges 48 received in the grooves 34 arranged in the sides of the guiding rails 22 and 24 facing away from the guiding groove 26.

For securing the guiding rails 22 and 24 in the work position illustrated in FIGS. 1 and 2, the processing device according to the invention is equipped with a stabilizing element denoted in its totality by 50 and releasably fastened to the guiding rails 22 and 24. The stabilizing element 50 extends approximately in the longitudinal direction of the guiding rails 22 and 24 and has an essentially T-shaped cross-section, as particularly clearly illustrated in FIG. 3. One of the legs of the stabilizing element 50 extends approximately parallel to the limiting surface of the guiding rails 22 and 24 provided with the grooves 34 and located opposite the guiding groove 26, while the other leg 54 extends starting from the center of this leg in a direction extending perpendicularly thereto away from the guiding rails 22 and 24.

The stabilizing element 50 is also secured by means of screws 58 to the fastening ledges 48 received in the grooves 34. For providing an intermediate space serving for receiving the flap-type hinge 40, spacer members 56 are arranged at the outer edges of the leg 52 of the stabilizing element 20 on the side facing the guiding rails 22 and 24, wherein the screws 58 extend through the spacer members 56. For reliably locking the stabilizing element 5050 relative to the guiding rails 22 and 24, at least one of the spacer members 56 is equipped on its side facing the grooves 34 with a guiding ledge received in the end area of the groove 34. The hinge flaps 42 and 44 are also equipped with guiding webs received in the end areas of the grooves 34.

For adjusting the processing device according to the invention from the work position illustrated in FIGS. 1 and 2 into a transport position, initially the stabilizing element 50 is removed together with the spacer members 56 by loosening the screws 56 from the guiding rails 22 and 24. The toothed belt 18 is then separated from the carriage 14. For this purpose, the carriage 14 is equipped with a fastening element 16 mounted on the toothed belt 18 through a screw 17, wherein the fastening element 16, in turn, is mounted through a screw 15 on the remainder of the processing tool. The fastening element 16 has in a direction extending perpendicularly of the direction of movement of the carriage 14 indicated by the double arrow P a greater width than the guiding groove 26. This prevents the fastening element 16 together with the toothed belt 18 from falling into the hollow space extending in the guiding rails 22 and 24 after the carriage 14 has been separated. In addition, a movement of the fastening element 16 along the predetermined path indicated by the double arrow P is limited by a limiting element 38 received in the guiding grooves 30.

After separating the stabilizing element 50 and the toothed belt 18, the guiding rails 22 and 24 can be tilted about the hinge axis of the hinge 40 or can be folded together in order to reach a transport position.

The invention is not limited to the embodiment explained with the aid of the drawing. Rather, it is also contemplated to use the guiding device illustrated in FIGS. 1 through 3 in connection with a cleaning tool which partially surrounds the guiding rails 22 and 24 and rests against guiding surfaces of these guiding rails 22 and 24 and which can be moved in the directions indicated by the double arrow P. The processing device according to the invention may also have more than only one processing tool in order to achieve in this manner a complete processing of the clothing in a particularly short time and with particularly short distances of moving the individual processing tools. Moreover, instead of the flap-type hinge illustrated in the drawing, other joints can be used for connecting the individual guiding rails 22 and 24.

While specific embodiments of the invention have been shown and described in detail to illustrate the inventive principles, it will be understood that the invention may be embodied otherwise without departing from such principles.

I claim:

1. A device for processing a card clothing mounted on a card clothing carrier, the device comprising at least one processing tool and a guiding device for guiding the processing tool along a predetermined path, wherein the guiding device comprises at least two guiding elements which are configured to be adjustable between a work position and a transport position, wherein the guiding elements extend in the work position along a longer portion of the predetermined path than in the transport position.

2. The device according to claim 1, wherein the guiding elements are connected to each other through at least one joint having a joint axis extending perpendicularly of the predetermined path.

3. The device according to claim 2, wherein the at least one joint is comprised of a flap-type hinge.

4. The device according to claim 2, further comprising a stabilizing element for stabilizing the guiding elements in the work position, wherein the stabilizing element is securable to at least one of the guiding elements.

5. The device according to claim 4, wherein the stabilizing element is releasably securable to at least one of the guiding elements.

6. The device according to claim 4, wherein the stabilizing element has in a sectional plane extending perpendicularly of the predetermined path an approximately T-shaped cross-section.

7. The device according to claim 4, wherein the stabilizing element comprises at least one spacer member, and wherein the stabilizing element is configured to be secured with the spacer member to at least one of the guiding elements, such that an intermediate space is formed for receiving at least a portion of the joint.

8. The device according to claim 4, wherein at least one of the stabilizing element and the joint has at least one coupling area and the guiding element has a coupling area for effecting a positively engaging connection between the coupling areas.

9. The device according to claim 8, wherein the at least one coupling area extends along the predetermined path.

10. The device according to claim 2, wherein at least one of the joint and the stabilizing element is arranged on a side of the guiding device facing away from the card clothing to be processed in the work position.

11. The device according to claim 1, wherein the at least one processing tool is coupled through a traction member to a drive device for moving the processing tool along the predetermined path.

12. The device according to claim 11, wherein the traction member is comprised of a toothed belt extending around a drive roller and a guide roller.

13. The device according to claim 11, wherein the traction member is releasably fastened to the processing tool.

14. The device according to claim 13, wherein the traction member is fastened to a fastening element of the processing tool, wherein the fastening element is releasably connected to a processing element of the processing tool.

15. The device according to claim 14, further comprising a limiting element configured to be securable relative to the guiding device and movable along the predetermined path for limiting movement along the predetermined path of the fastening element of the processing tool separated from the processing element.

16. The device according to claim 15, wherein the processing tool has a guiding portion and wherein at least one of the guiding elements has a guiding groove extending along the predetermined path for receiving the guiding portion.

17. The device according to claim 16, wherein the fastening element has stop area for preventing the fastening element from completely penetrating into the guiding groove after separation of the fastening element from the processing element.

18. The device according to claim 16, wherein the guiding groove opens into a hollow space, wherein the hollow space extends through the guiding element in the direction of the predetermined path and is configured for receiving the traction member.

* * * * *